US005739830A

United States Patent [19]

John et al.

[11] Patent Number: 5,739,830

[45] Date of Patent: Apr. 14, 1998

[54] MONOLITHIC PRINTHEADS FOR INK JET PRINTING APPARATUS

[75] Inventors: Peter J. John, Rochester; Joseph J. Wysocki, Webster; Joseph F. Stephany, Williamson; Richard V. LaDonna, Fairport; Thomas E. Watrobski, Penfield; Gary A. Kneezel, Webster; James Eaton, Walworth, all of N.Y.

[73] Assignee: Xerox Corporation, Stamford, Conn.

[21] Appl. No.: 368,929

[22] Filed: Jan. 5, 1995

[51] Int. Cl.[6] ..... B41J 2/01

[52] U.S. Cl. ..... 347/49

[58] Field of Search ..... 347/49

[56] References Cited

U.S. PATENT DOCUMENTS

Re. 32,572 1/1988 Hawkins et al. .

4,571,599 2/1986 Rezanka .

4,774,530 9/1988 Hawkins .

5,148,194 9/1992 Asai et al. ..... 347/49

5,257,044 10/1993 Carlotta et al. .

5,504,513 4/1996 Nobel et al. ..... 347/49

*Primary Examiner*—Valerie Lund

*Attorney, Agent, or Firm*—Fay, Sharpe, Beall, Fagan, Minnich & McKee

[57] ABSTRACT

Individual printheads are joined together in a manner to provide improved alignment and registration. The multiple printhead assembly is then installed and removed from the printer as a single unit. According to a preferred method of forming the assembly, individual printheads are temporarily mounted on a holddown plate. The location and position of the printheads is monitored and a fast-cure adhesive used to monolithically join the individual printheads together as a unitary assembly. Once the adhesive is cured, the temporary securing of the individual printheads is removed and the entire assembly removed as a single unit from the holddown plate.

13 Claims, 8 Drawing Sheets

MONOLITHIC PRINTHEADS FOR INK JET PRINTING APPARATUS

BACKGROUND OF THE INVENTION

This invention pertains to the art of printers and more particularly to an ink jet printer. It is particularly applicable to a multi-printhead printer such as a color ink jet printer and will be described with particular reference thereto. However, it will be appreciated that the invention has broader applications and may be advantageously employed in other related environments and applications.

Thermal ink jet printers employ a print cartridge having an ink reservoir that provides a supply of ink to small nozzle openings in the printhead. One or more cartridges are mounted on a carriage that reciprocates on a guide rail through a printing region so that the nozzle openings are disposed closely adjacent a recording medium such as paper. Each pass of the cartridge allows the printheads to deposit tiny droplets of ink in a desired pattern or configuration to form alpha-numeric characters, graphics, or the like.

Resistors are associated with chambers defined adjacent the nozzle openings so that once an electric pulse is provided to the resistor, the ink in the chamber is rapidly super heated. This heating results in formation of a bubble that expels droplets of ink from the nozzle openings so that closely spaced ink spots can be formed on the paper in the desired array. More particular details of the structure and operation of ink jet printheads can be found in commonly assigned U.S. Pat. Nos. 4,571,599; 4,774,530; and Re. 32,572.

These general principles are also employed in color printers where various colors of ink are used to provide a wide spectrum of gray scales and colors. A basic four color system employs typically four printheads. Each printhead includes its own reservoir of ink of a different color. The commonly used ink colors are cyan, yellow, magenta, and black. A particular printed character, therefore, can be formed from a number of different color spots. As will be appreciated, precise alignment, registration, and indexing of the individual printheads of different colors becomes a critical consideration in color printers because of the need to accurately locate the various ink spots which originate from different printheads.

Conventionally, positioning and alignment of the multiple printheads is achieved through the mechanical connection of each individual printhead to the carriage and/or to adjacent printheads that are received on the carriage. Tolerance problems, however, preclude this arrangement from achieving the desired precision where high resolution is required and accurate positioning and alignment of the individual printheads is required. In addition, if the multiple printheads are not permanently joined together, subsequent handling by the user, for example to renew the ink supply, may compromise the precision alignment.

SUMMARY OF THE INVENTION

The present invention contemplates a new and improved multi-printhead assembly for an ink jet printer and a method of forming same that overcomes the above-referenced problems and others and provides for accurate registration and alignment in a simple and efficient manner.

According to the present invention, a multiple printhead assembly includes discrete, plural printheads each having its own reservoir of ink in communication with its own set of nozzle openings. The printheads are monolithically joined together for packaging, sale, and use as a single unit on a carriage of an ink jet printer.

According to another aspect of the invention, the printheads are oriented in a desired relation and a fast cure adhesive interposed between the individual printheads to monolithically join them together.

According to a method of forming the monolithic printhead assembly, a holddown surface temporarily retains the individual printheads. The orientation is precisely set and the printheads then joined together before removing the assembly from the holddown surface.

According to a more limited aspect of the forming method, indicia are provided on the holddown surface to aid in desired alignment of the printheads, a video camera monitors the alignment through the transparent holddown surface, and a source of vacuum preferably used to temporarily hold the individual printheads in place.

A principle advantage of the invention resides in the precise positioning and alignment of the individual printheads into a monolithic unit.

Another benefit of the invention resides in precisely and accurately aligning the multiple printheads to provide desired accuracy in the final printed configuration.

Yet another advantage of the invention is a monolithic printhead assembly that provides ease of access to ink manifolds, electrical connections, and the like.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings. The drawings include.

DETAILED DESCRIPTION OF THE PREFERRED EMBODIMENT AND METHOD

Figure 1:
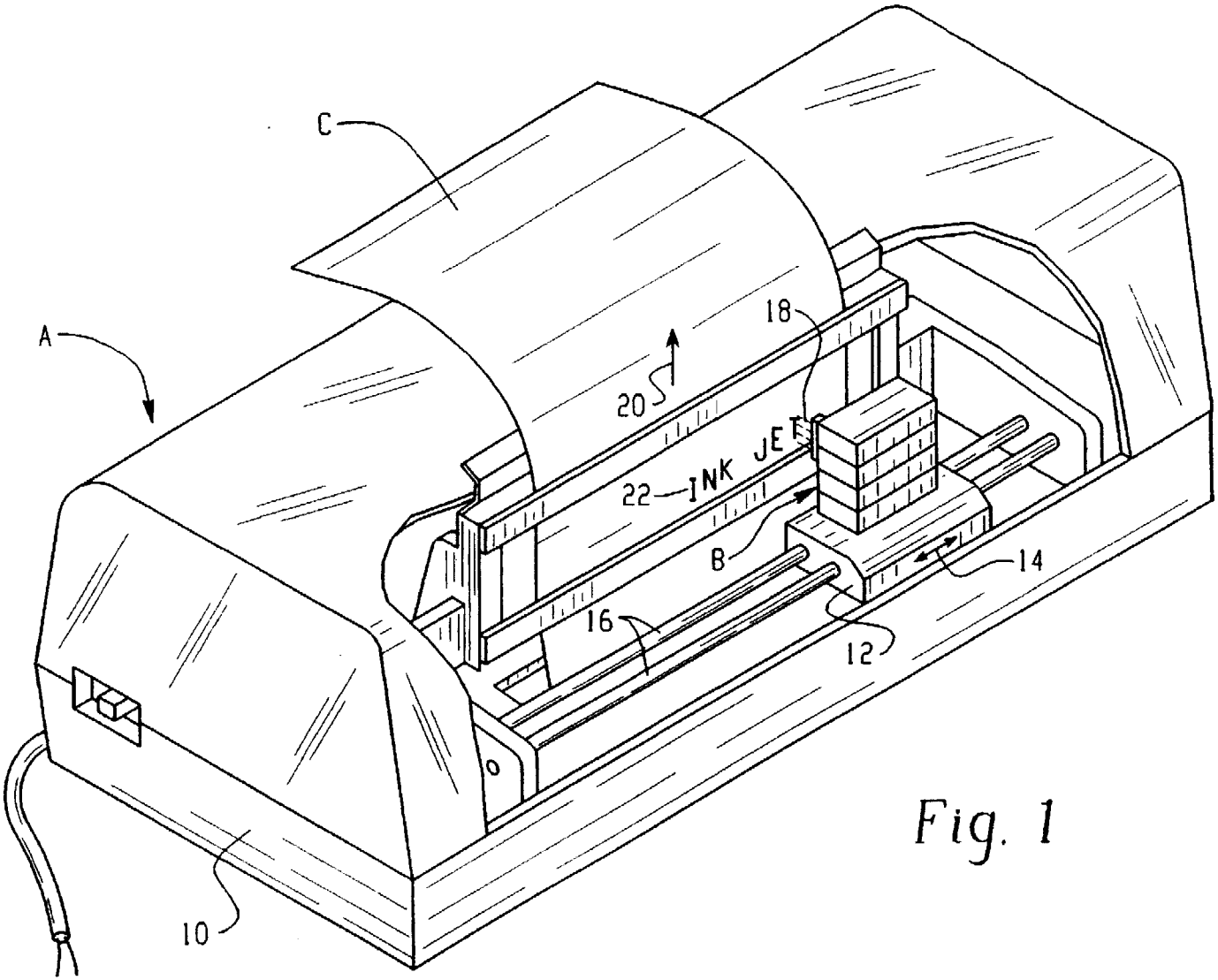
FIG. 1 is a perspective view of an ink jet printer that includes a multiple printhead assembly formed in accordance with the teachings of the subject invention.

Referring now to the drawings wherein the showings are for the purposes of illustrating the preferred embodiment and method of the invention only and not for purposes of limiting same, the FIGURES show a printing device such as an ink jet printer A in which a multiple printhead assembly B dispenses ink in a predetermined pattern or configuration on a recording medium such as a sheet of paper C. More particularly, and with reference to FIG. 1, the printer A includes a housing 10 in which a carriage 12 is disposed for reciprocating movement as represented by arrows 14 along one or more guide rails 16. The printhead assembly B is positioned for dispensing droplets of ink 18 onto the paper in a desired pattern, and as generally described above. More particular details of the structure and operation of thermal ink jet printheads are well known in the art and form no part of the subject invention so that further discussion is deemed unnecessary. The paper is incrementally advanced in a direction shown by arrow 20 so that as the printhead assembly reciprocates along the guide rails, a pass over the paper prints a swath of information such as represented by numeral 22.

Figure 2:
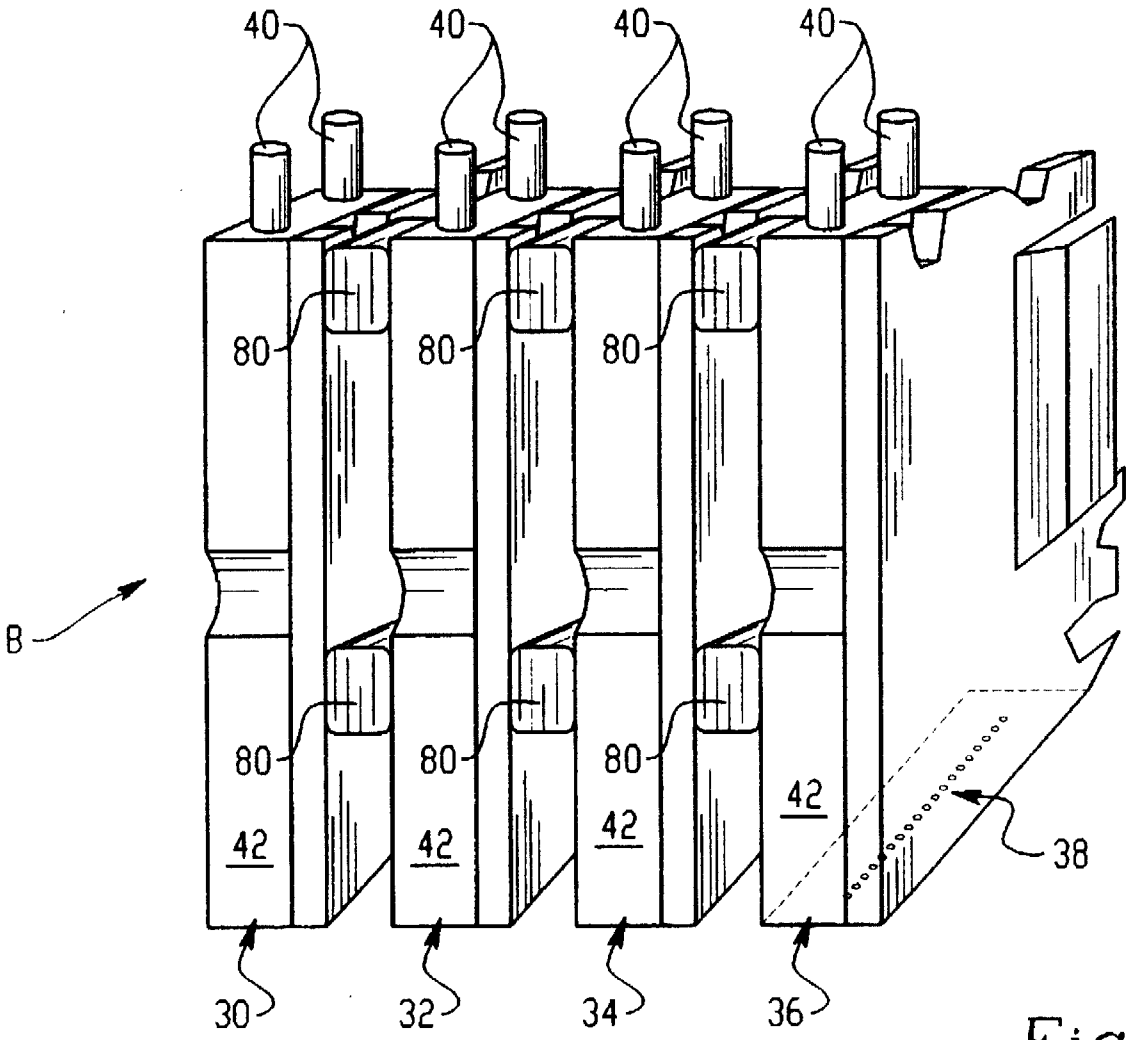
FIG. 2 is an enlarged perspective view generally taken from the rear and underside of the monolithically joined individual printheads that define a multiple printhead assembly.

With continued reference to the overall environment of FIG. 1, and the more particular details of the printhead assembly shown in FIG. 2, it is evident that the printhead assembly B is advantageously comprised of unitarily joined individual printheads 30, 32, 34, 36. For purposes of the following discussion, it will be understood that each printhead is of substantially similar structure to the other so that description of individual components of one is equally applicable to the others unless noted to the contrary. Moreover, the printheads are similarly oriented so that an array or set of nozzle openings 38 associated with each individual printhead (shown only on printhead 36 for ease of illustration) will be similarly oriented with the nozzle openings of the remaining printheads of the assembly. Nozzle openings are typically arranged in a linear array, but may also be arranged in a two dimensional array.

Figure 3:
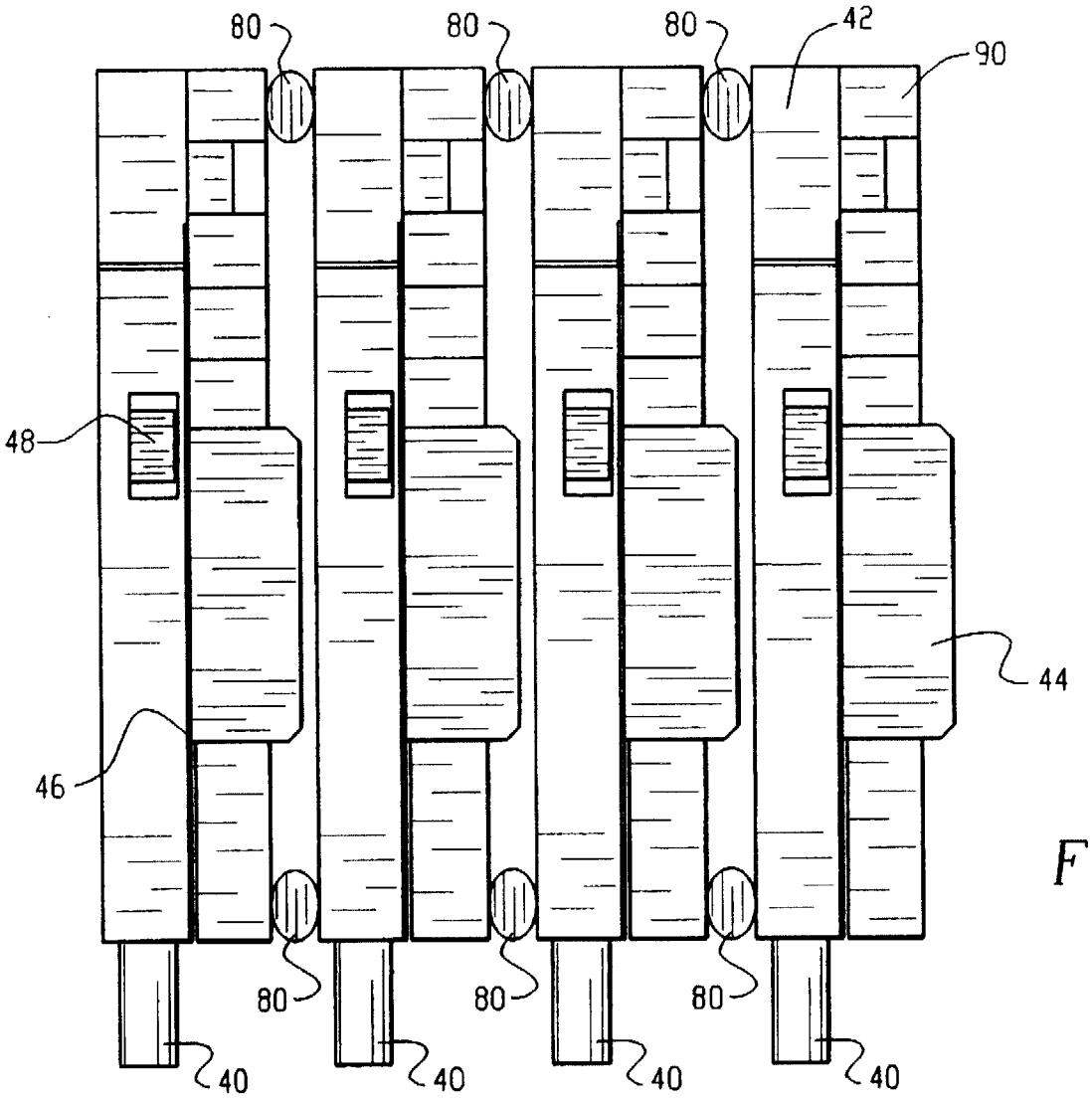
FIG. 3 is a top plan view of the printhead assembly of FIG. 2.

Ink inlets 40 are provided in each printhead and communicate with a reservoir or ink manifold 42. This arrangement of manifolds with ink inlets is well suited to the case of larger ink supplies connected by tubing to the printheads. Optionally, the ink reservoir for each printhead may be self-contained with no ink inlets. Such ink cartridges may be disconnectable from their respective printheads and replaced by the user when empty. Repeated replacement of ink cartridges could cause relative misalignment of the printheads unless they are rigidly and monolithically bonded together. Moreover, each printhead includes an electrical connector 44 (FIG. 3) that allows electrical impulses from a printer controller to be provided to the printed wiring board 46 that works in conjunction with a chip capacitor 48 and a resistor element associated with the thermal ink jet die or nozzle openings to form droplets of inks in the desired pattern.

As shown, the preferred printhead assembly includes four separate printheads in which each printhead stores an individual quantity of a different ink color. By way of example only, the first printhead 30 stores cyan colored ink, the second printhead 32 contains yellow ink, the third printhead 34 has magenta ink, and the fourth printhead 36 contains black ink. A greater number of individual printheads may be assembled together in accordance with the teachings of the subject invention (for example with different ink densities or spot sizes for gray scale printing), and likewise a lesser number could also be joined together. For example, the cyan, magenta, and yellow printheads may be monolithically joined, and the black printhead mounted as a separate unit which is individually replaceable. It may be appreciated that the individual printheads may optionally be print tested prior to assembling them together monolithically to ensure that the entire unit will have the required print quality.

Figure 4:
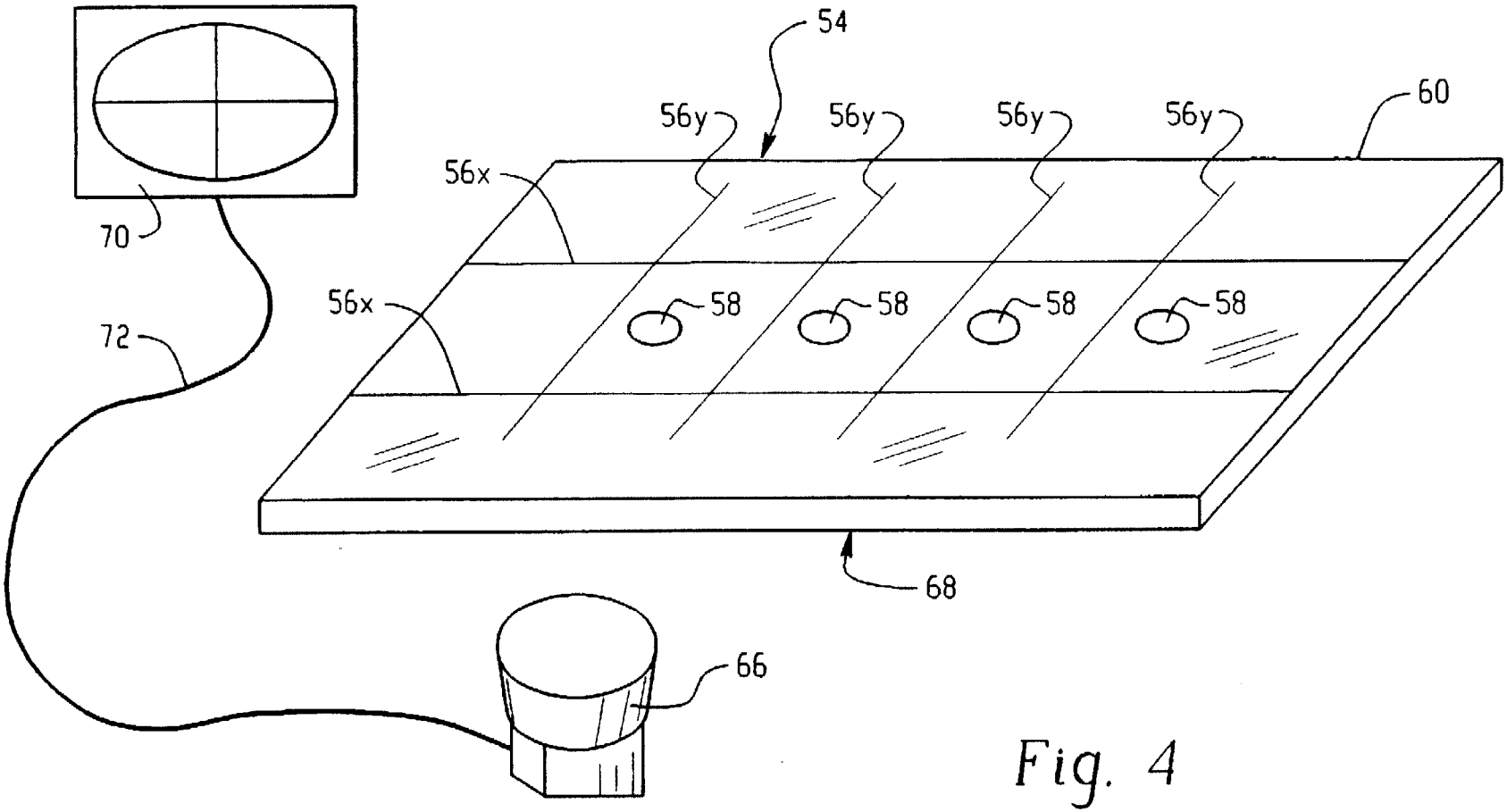
FIG. 4 is a schematic representation of a transparent holddown plate and video monitoring equipment used in the preferred method of forming the monolithic printhead assembly.

FIG. 4 discloses a holddown plate 54 that is formed from glass or similar transparent material. An upper surface of the holddown surface includes indicia such as scribed or photo patterned lines 56. In accordance with the preferred arrangement, these locating features are oriented in a matrix fashion to define an accurate coordinate system where parallel lines 56*y* and parallel lines 56*x* are perpendicular to one another to form cross hairs on the holddown surface. Preferably, the spacing between parallel lines 56*y* is preselected to define the desired spacing between the individual printheads of the final printhead assembly.

Also provided in the holddown surface is a means for temporarily securing individual printheads to the holddown plate. In the preferred arrangement, openings 58 are provided through the plate and communicate with a source of vacuum (not shown). As will be more fully understood below, the openings temporarily secure the printheads to the upper surface 60 of the holddown plate when operatively connected to the vacuum source. The vacuum openings, though, also permit selective re-orienting or movement of the individual printheads on the holddown plate until the desired alignment is achieved.

A monitoring unit preferably includes a video camera 66 disposed below the lower surface 68 of the holddown plate. Since the holddown plate is transparent, the video camera provides an enlarged view through the underside of the glass plate allowing the operator/assembler to monitor the relative positioning of the individual printheads. A monitor 70 can be disposed at a remote location and is connected to the camera through line 72.

Optionally, the viewing system has split field optics so that features at both ends of the printhead may be aligned to the holddown plate locating features, before moving the optics to align the next printhead.

Figure 5:
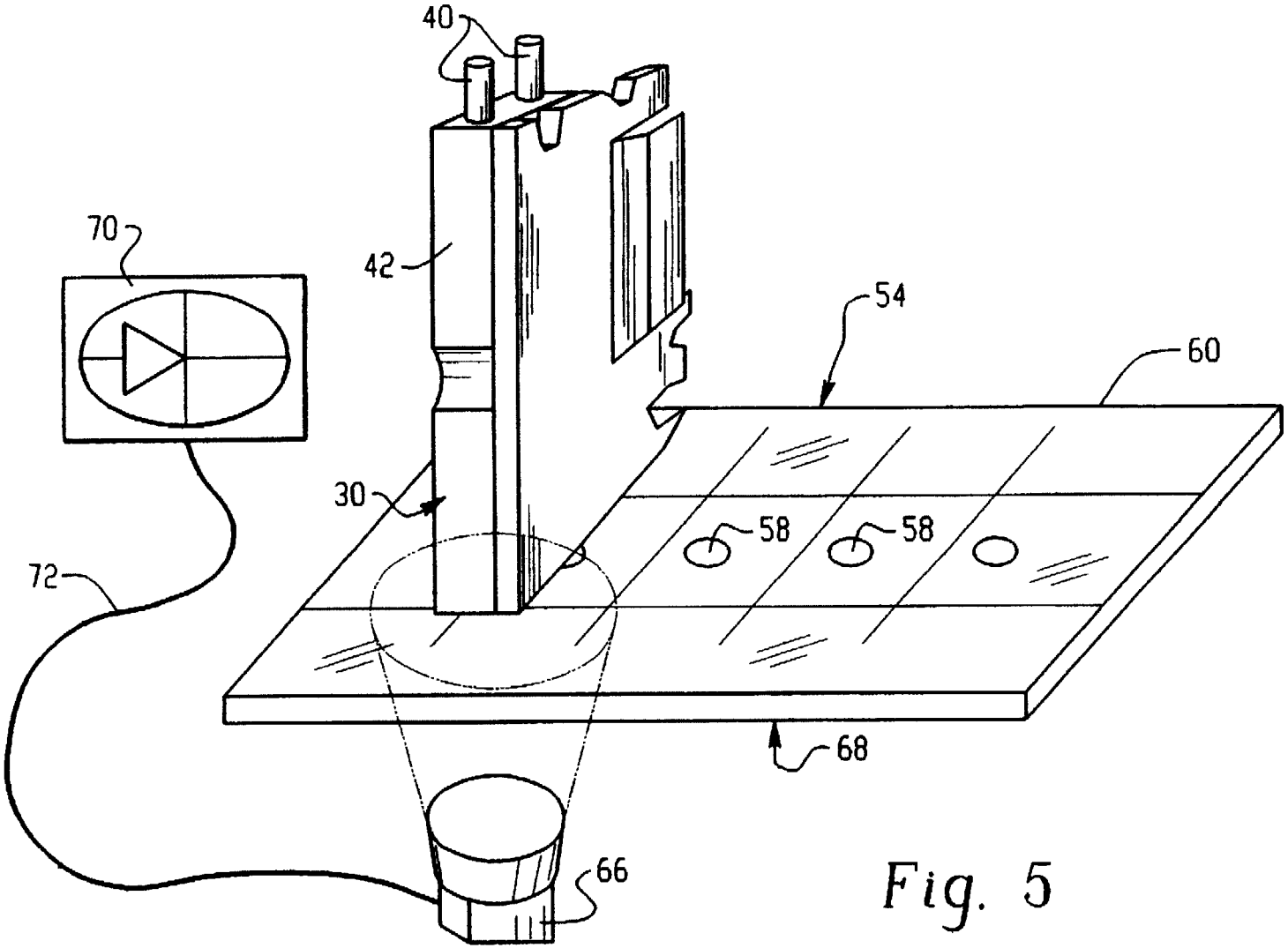
FIG. 5 illustrates initial steps in forming the monolithic printhead assembly in accordance with the preferred method.

As shown in FIG. 5, the first printhead 30 is advanced onto the upper surface 60 of the holddown plate. It is oriented so that the nozzle openings are situated on or abut the upper surface of the plate whereby the operator/assembler can examine the desired position of the nozzle openings relative to the cross hairs scribed in the glass. Each intersection of the scribed lines is used as a reference point to determine the desired location of the printhead nozzle openings. Once the first printhead is manipulated and positioned as desired, it is then temporarily held in place. As indicated above, the vacuum openings 58 serve this purpose and effectively hold the printhead in place. Alternatively, a temporary fixturing adhesive could be used to hold the individual printhead in the desired location. Other temporary clamping means, such as an electromagnet, could optionally be used to hold the printhead in position.

Figure 6:
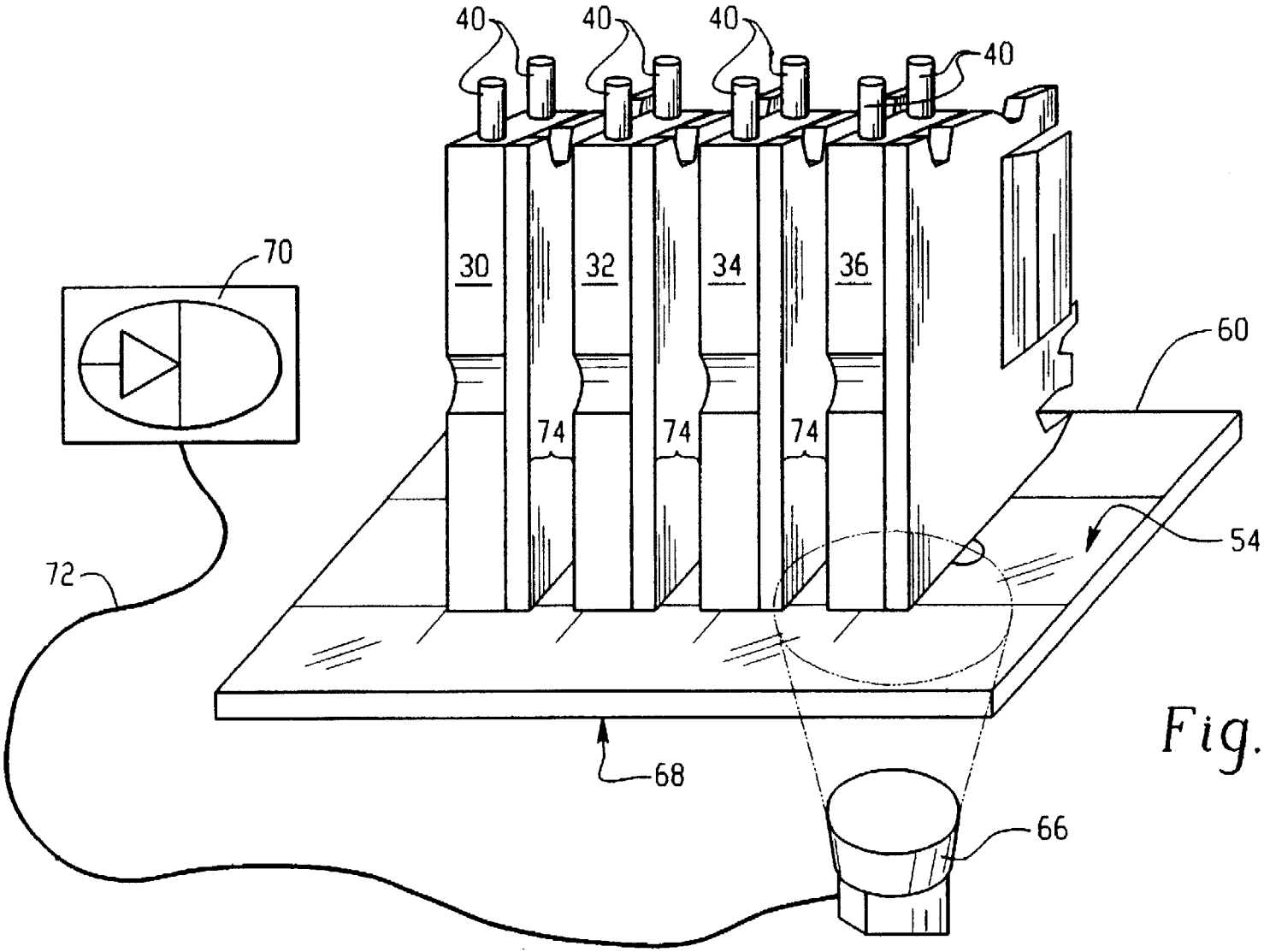
FIG. 6 illustrates intermediate steps in the method of assembly.

As represented in FIG. 6, the same positioning, monitoring, and temporary securing of printheads 32, 34, and 36 to the holddown plate is achieved. The individual printheads are separated by a gap 74 and effectively held in place by the vacuum supplied to openings 58. The gaps 74 are shown as nominally identical but this is not essential. It is the nozzle openings which must be precisely aligned.

Figure 7:
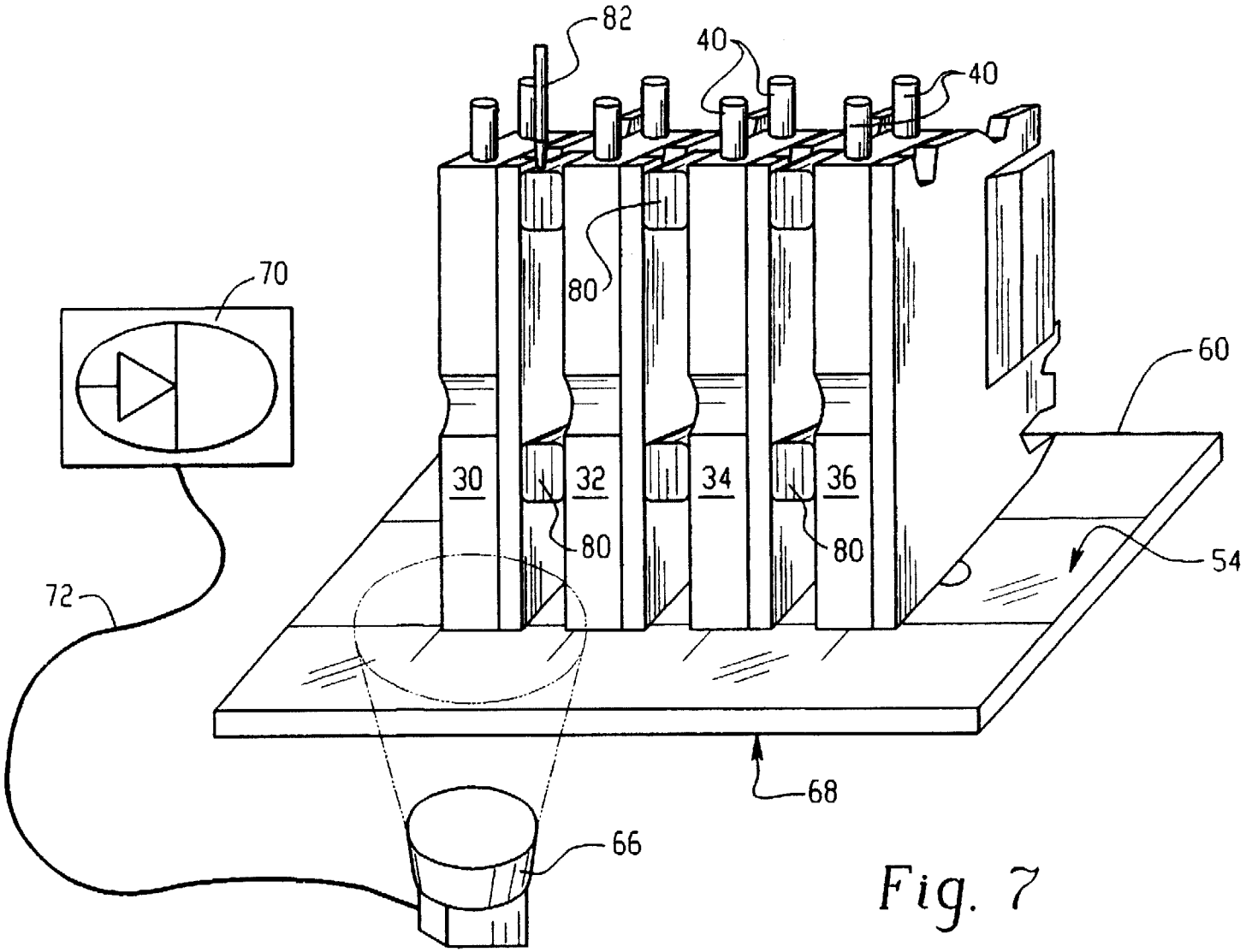
FIG. 7 represents still further steps in manufacturing the unitary printhead assembly.

FIG. 7 illustrates the application of an adhesive as the desired means for monolithically joining the individual printheads together as a single or unitary printhead assembly. According to the preferred arrangement, an ultraviolet curing adhesive 80 is provided through dispensing nozzle 82 at spaced locations into the gaps 74 between the printheads. For example, the ultraviolet curing adhesive can be a urethane based product that quickly and effectively cures to rigidly hold the individual printheads together when exposed to ultraviolet light.

Figure 8:
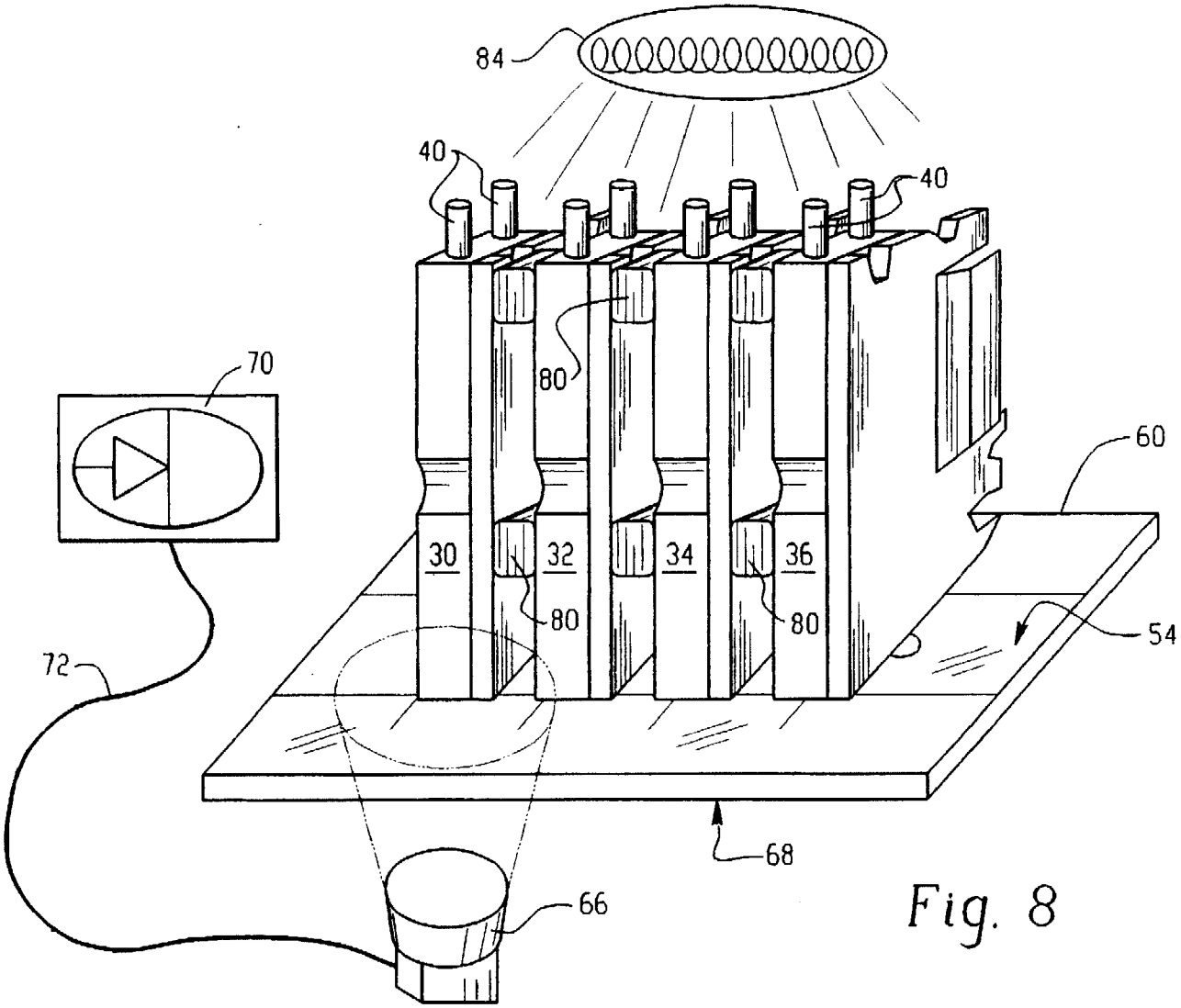
FIG. 8 represents a step of curing the adhesive holding the assembly together.

The curing step is represented in FIG. 8. Here, a source of ultraviolet light 84 is used so that the adhesive 80 is exposed to the light and monolithically joins the individual printheads together. In other arrangements, curing may be facilitated with forced air, heat application, or the like. Only after the curing operation is complete can the temporary securing be deactuated. Thus, in the preferred arrangement, the source of vacuum is terminated to the individual openings once the adhesive has cured. This assures that the dimensional spacing and precise alignment between the individual printheads is maintained until a monolithic unit has been completed.

The printhead assembly can then be removed as a single unit from the holddown plate. Thus, the completed assembly as shown in FIG. 2 is ready for installation into an ink jet printer by installing the multiple printhead assembly as a one-piece arrangement on the carriage. Individual connections between the printer and the electrical connectors 44 can be made without interfering with the desired alignment between the individual printheads. Moreover, this proposed method of laminating the printheads together still provides ease of access to the ink manifolds.

As will also be noted, heat sinks 90 (FIG. 3) can be provided with each individual printhead and are preferably interleaved throughout the printhead assembly. The heat sinks help to control the temperature of the printheads. This convenient joining assembly does not adversely effect the heat sink requirements and, in fact, easily accommodates them into the assembly.

Although the printheads have been depicted as having the same size, the invention is also applicable to the case of printheads having different sizes. For example, there are applications in which it may be desirable for the black printhead to have more nozzles than any of the color printheads. In such a case, the holddown plate (FIG. 4) would be modified to accommodate the longer printhead.

The invention has been described with reference to the preferred embodiment and method of forming same. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A method of forming a printhead assembly for a printing device, the method comprising the steps of:

providing a holddown surface on which the printhead assembly is temporarily retained during the forming method;

orienting an individual first printhead on the holddown surface in a preselected manner;

temporarily securing the first printhead to the surface;

orienting one or more individual additional printheads on the holddown surface relative to the first printhead in a preselected manner;

temporarily securing the one or more additional printheads to the holddown surface;

joining the plurality of printheads together to form a printhead assembly while secured to the holddown surface; and removing the printhead assembly from the holddown surface.

2. The method as defined in claim 1 comprising the further step of providing indicia on the holddown surface to facilitate desired alignment of the printheads.

3. The method as defined in claim 2 comprising the further step of providing a transparent surface for the holddown surface whereby nozzle openings in the printheads can be viewed through the surface.

4. The method as defined in claim 3 comprising the further step of using a video camera to monitor the alignment of the printheads prior to the joining step.

5. The method as defined in claim 1 wherein the temporary securing steps include providing a source of vacuum to the holddown surface to maintain the printheads in desired location.

6. The method as defined in claim 1 wherein the joining step includes adhesively securing the individual printheads together.

7. The method as defined in claim 6 wherein the adhesively securing step includes using a fast curing adhesive.

8. The method as defined in claim 6 wherein the step of adhesively securing the printheads together includes using a light curing adhesive.

9. The method as defined in claim 1 wherein the printheads are substantially identical and the orienting step includes positioning the individual printheads in like orientation on the holddown surface.

10. The method as defined in claim 1 wherein the printheads do not all have the same number of nozzles and the orienting step includes positioning the individual printheads in like orientation on the holddown surface.

11. A method of forming a printhead assembly for a printing device, the method comprising the steps of:

determining a location of nozzle openings on a first printhead;

orienting the first printhead based on the location of the nozzle openings on the first printhead;

determining a location of nozzle openings on a second printhead;

orienting the second printhead relative to the first printhead based on the location of the nozzle openings on the second printhead; and joining the first and second printheads together after the orienting steps, which include temporarily securing the printheads to a holddown surface and providing indicia on the holddown surface to facilitate orienting the printheads; and providing a transparent surface for the holddown surface whereby the nozzle openings in the printheads can be viewed through the surface.

12. The method as defined in claim 11 comprising the further step of using a camera to monitor the alignment of the printheads prior to the joining step.

13. The method as defined in claim 11 wherein the temporary securing step includes providing a source of vacuum to the holddown surface to temporarily maintain the printheads in the desired orientations until the joining step is complete.

* * * * *